United States Patent [19]

Rand

[11] 4,261,111

[45] Apr. 14, 1981

[54] DEGREASING APPARATUS

[75] Inventor: Burton Rand, Collegeville, Pa.

[73] Assignee: Autosonics, Inc., Norristown, Pa.

[21] Appl. No.: 48,558

[22] Filed: Jun. 14, 1979

[51] Int. Cl.[3] ..... F26B 11/18

[52] U.S. Cl. ..... 34/73; 34/78; 34/37

[58] Field of Search ..... 34/73, 78, 36, 37, 77; 134/11, 31; 202/180

[56] References Cited

U.S. PATENT DOCUMENTS

| | | | |
|---|---|---|---|
| 3,375,177 | 3/1968 | Rand | 34/73 |
| 3,460,990 | 8/1969 | Barday | 134/11 |
| 4,029,517 | 6/1977 | Rand | 134/11 |
| 4,098,005 | 7/1978 | Wiarda | 34/73 |
| 4,101,340 | 7/1978 | Rand | 134/11 |

*Primary Examiner*—Larry I. Schwartz

*Attorney, Agent, or Firm*—Seidel, Gonda, Goldhammer & Panitch

[57] ABSTRACT

A housing contains a sump located below a partition wall having an opening which communicates the sump with a work receiving chamber above the partition wall. An upper condenser is provided in said chamber and a lower condenser in said sump. A chilled coil is located in the chamber above the elevation of the upper condenser but below the upper lip of the housing. Between the upper lip of the housing and the chilled coil, there is provided a vapor discharge port.

7 Claims, 1 Drawing Figure

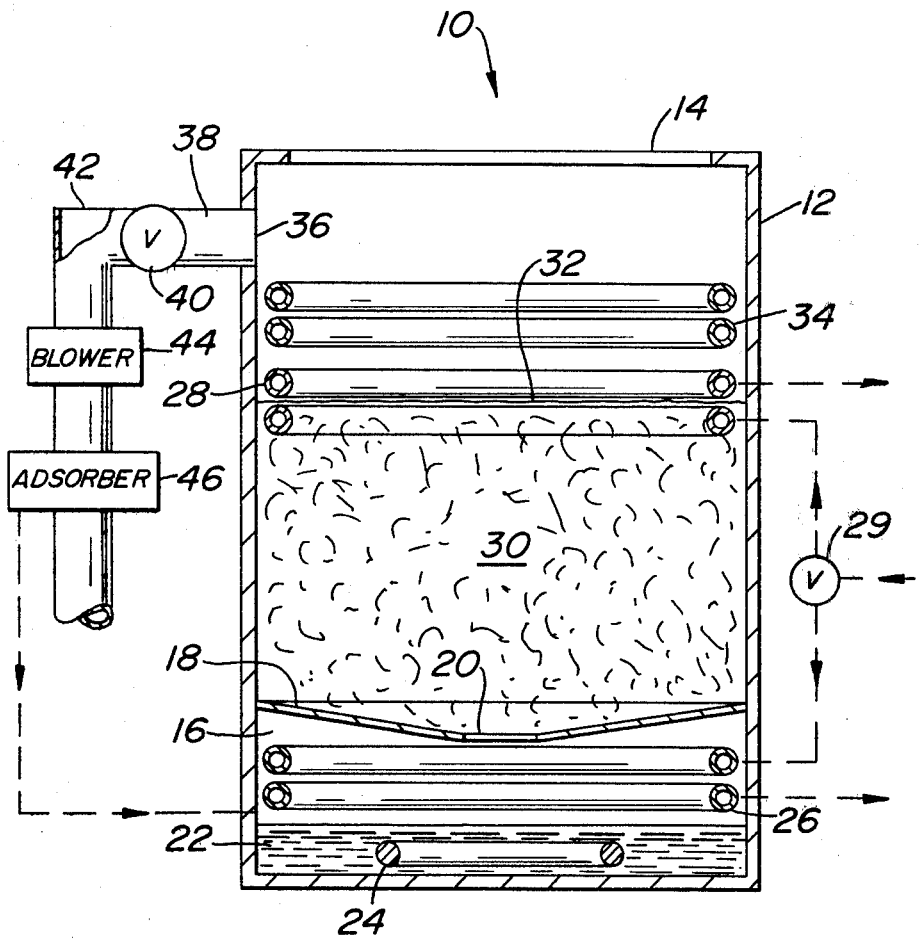
10
14
38
42
36
12
V
32
40
34
BLOWER
44
28
ADSORBER
46
29
30
V
18
20
16
26
22
24

DEGREASING APPARATUS

SUMMARY OF THE INVENTION

The present invention is directed to degreasing apparatus which includes a housing which is preferably of the open top type. The housing contains a sump located below a partition wall having an opening which communicates the sump with a work receiving chamber above said wall. An upper condenser is provided in said chamber for defining the upper limit of a vapor zone. A lower condenser is provided in said sump for causing collapse of vapors through said opening into said sump. A chilled coil is provided in said chamber above the elevation of the upper condenser. The housing has a vapor discharge port above the elevation of said chilled coil and below the upper lip of said housing.

It is an object of the present invention to provide a novel degreasing apparatus which is less expensive and has fewer components as compared with the prior art degreasing apparatus while being comparably or more effective in preventing the escape of vapors to the surrounding environment.

Other objects will appear hereinafter.

For the purpose of illustrating the invention, there is shown in the drawing a form which is presently preferred; it being understood, however, that this invention is not limited to the precise arrangements and instrumentalities shown.

The FIGURE is a vertical sectional view through apparatus of the present invention.

Referring to the drawing in detail, wherein like numerals indicate like elements, there is shown in the drawing degreasing apparatus in accordance with the present invention designated generally as 10.

The apparatus 10 includes a housing 12 having side walls and a bottom wall. The housing is preferably provided with an open top. Notwithstanding the fact that the top is open, the present invention as will be made clear hereinafter minimizes any escape of vapors through the open top. If desired, the housing 12 may be provided with a door across the open top. The open top is preferred since it expedites introducing work to be degreased into the housing 12 and withdrawal of such work from the housing 12.

The housing 12 has a sump 16 below the partition wall 18. The partition wall 18 has an opening 20 which is centrally located. The opening 20 need not be provided with any closure or door. Partition wall 18 is preferably sloped toward the opening 20.

The sump 16 includes a solvent 22 which may be any one of a wide variety of commercially available solvents which vaporize with the application of heat. To apply heat to effect vaporization of the solvent 22, an electrical heater 24 or any other conventional source of heat may be provided. The sump 16 also includes a lower condenser 26.

An upper condenser 28 is provided within the housing 12 above the elevation of the partition wall 18. Condenser 28 defines the upper limit 32 of the vapor zone 30. Condensers 26 and 28 may be in series and coupled to a single source of a coolant by way of the valve 29. If said coils are in series, valve 29 will alternatively direct coolant to either coil 26 or to coil 28 since the coils should not be operative simultaneously.

A chilled coil 34 is supported within the housing 12 above the elevation of the upper condenser 28. Housing 28 is provided with a vapor discharge port 36 in a side wall thereof below the upper lip of the housing 12 and above the elevation of the chilled coil 34. A downwardly extending conduit 38 communicates with port 36.

The conduit 38 includes a valve 40 which is selectively operable and upstream from an air bleed port 42. Port 42 facilitates bleeding surrounding air into the conduit 38 to avoid creating turbulence in the freeboard area which would be the case if all flow in conduit 38 were derived from the freeboard area. Conduit 38 may include a blower 44 having its outlet connected to the inlet side of an absorber 46 or an adsorber such as a carbon bed. The outlet of absorber 46 may communicate with the surrounding environment or may be directed exterior of the building in which the apparatus 10 is located for discharge to the surrounding atmosphere.

The apparatus 10 operates as follows. The lower condenser 26 is inoperative. A coolant such as cool water is fed to the upper condenser 28. Vapors are generated in the sump 16 and rise upwardly through the opening 20 into the vapor zone 30. The upper condenser 28 contains coolant adequate in volume and temperature for the solvent being used to cause the vapor zone 30 to terminate at the elevation thereof. Work is introduced through the open top 14 into the vapor zone 30 and supported by the partition wall 18 or is otherwise suspended within the vapor zone 30.

A coolant is introduced into the chill coil 34 which creates an inversion blanket over the vapor zone 30. An inversion blanket is a work-permeable dense barrier of cold dry air which inhibits vapor diffusion. The coolant directed to the chill coil 34 is at least 30° F. below ambient temperature, may be in the range of 32° to 40° F., but may be below 32° F. The chill coil 34 is adjacent the elevation of the port 36. Any vapors that escape from the vapor zone 30 and pass upwardly through the inversion blanket are attracted toward the chill coil 34 and the side walls of the housing 12 by the chill coil 34. These vapors are heavier than air and take the path of least resistance outwardly through the port 36 into conduit 38 which is a controlled path instead of escaping out from the top of housing 12. Blower 44 operates at a sufficiently low level so as to direct the vapors in conduit 38 to flow to the absorber 46 while being blended with environmental air entering port 42 under the suction effect of blower 44. At the absorber 46, vapors are separated from air with the collected condensate and any carrier such as oil being returnable to the sump 16 or other vessel for subsequent distillation.

When it is desired to remove the work from the vapor zone 30, valve 29 is operated to direct coolant to the lower condensing coil 26 while terminating flow to the upper condensing coil 28. At the same time, heater 24 if operative may be turned off or reduced. The lower condensing coil 26 causes the vapor zone 30 to collapse through opening 20 into the sump 16. I have found the lower condenser 26 will maintain the vapor line 32 below the elevation of the opening 20 which is sealed by the inversion blanket which dropped with the vapor zone 30. Hence, it is not necessary to provide a mechanical control device for the opening 20. At the same time, the collapse of vapors provides a high freeboard height.

Comparative test data revealed the following unexpected results. With condenser 26 off, valve 40 closed, and chill coil 34 operating at about 34°–37° F., readings showed about 90–225 parts per million of trichloroethylene at the operator's breathing level about 6 inches above the top of housing 12. With valve 40 open, the readings dropped to about 45 parts per million. When the temperature of coil 34 was reduced to about −20° F., the readings dropped to 20–50 parts per million with valve 40 closed and then down to 0–30 parts per million with valve 40 open. Hence, significant reductions in the amount of vapors at the operator's level were obtained when port 36 was opened.

The present invention may be embodied in other specific forms without departing from the spirit or essential attributes thereof and, accordingly, reference should be made to the appended claims, rather than to the foregoing specification, as indicating the scope of the invention.

I claim:

1. Degreasing apparatus comprising a housing containing a sump located at an elevation below a partition wall in said housing, said partition wall having an opening which communicates the sump with a work receiving chamber above said wall, an upper condenser in said chamber for defining the upper limit of a vapor zone within said housing, a lower condenser in said sump for causing a vapor zone to collapse through said opening into said sump, means including a discrete chilled coil in said chamber above the elevation of said upper condenser for creating an inversion blanket over the vapor zone, means including a vapor discharge port in a wall of said housing above the elevation of said chilled coil and below the upper lip of said housing for discharge of vapors attracted to the walls of said housing by said chilled coil, the temperature of said chilled coil when operative being at least 30° F. below ambient temperature and substantially cooler than the temperature of said condensers.

2. Apparatus in accordance with claim 1 wherein said last mentioned means includes a conduit connected to said discharge port, said conduit having an air bleed port outside said chamber to facilitate introduction of environmental air into said conduit upstream from a blower in said conduit.

3. Apparatus in accordance with claim 1 wherein said housing is an open top housing, said opening providing constant communication between said sump and a vapor zone in the housing between the elevations of the partition wall and upper condenser.

4. Apparatus in accordance with claim 1 wherein said partition wall slopes from its outer periphery toward said opening, said opening being centrally located in said partition wall.

5. Apparatus in accordance with claim 1 wherein said sump includes a solvent bath and a heater immersed in said bath, said bath being below the elevation of said lower condenser.

6. Degreasing apparatus comprising an open top housing containing a sump located below a partition wall in said housing, said partition wall having a centrally disposed opening which communicates the sump with a work receiving chamber above said wall, an upper condenser in said chamber for defining the upper limit of a vapor zone, a lower condenser in said sump, a solvent bath in said sump below the elevation of said lower condenser, a heater associated with said bath, a chilled coil operative at a temperature of not more than 40° F., said chilled coil being in said chamber above the elevation of said upper condenser for creating an inversion blanket over the vapor zone, said housing having a vapor discharge port above the elevation of said chilled coil and extending through a side wall of said housing, a valved conduit communicating with said vapor discharge port, a blower in said conduit for removing vapor without creating turbulence in said chamber, said conduit having a air bleed port between the valve in said conduit and said blower.

7. Degreasing apparatus comprising a housing containing a sump which communicates with a work receiving chamber thereabove, a condenser in said chamber for defining the upper limit of a vapor zone within said housing, means including a discrete chilled coil in said chamber above the elevation of said upper condenser for creating an inversion blanket over the vapor zone, means including a vapor discharge port in a wall of said housing above the elevation of said chilled coil and below the upper lip of said housing for discharge of vapors attracted to the walls of said housing by said chilled coil, the temperature of said chilled coil when operative being at least 30° F. below ambient temperature and substantially cooler than the temperature of said condenser, said last mentioned means including a conduit connected to said discharge port, said conduit having an air bleed port outside said chamber to facilitate introduction of environmental air into said conduit upstream from a blower in said conduit.

* * * * *